US005675701A

United States Patent [19]

Kleijn et al.

[11] Patent Number: 5,675,701

[45] Date of Patent: Oct. 7, 1997

[54] SPEECH CODING PARAMETER SMOOTHING METHOD

[75] Inventors: Willem Bastiaan Kleijn, Basking Ridge, N.J.; Hans Petter Knagenhjelm, Molnlycke, Sweden

[73] Assignee: Lucent Technologies Inc., Murray Hill, N.J.

[21] Appl. No.: 430,676

[22] Filed: Apr. 28, 1995

[51] Int. Cl.[6] ..... G10L 9/00

[52] U.S. Cl. ..... 395/2.31

[58] Field of Search ..... 395/2.28, 2.29, 395/2.39, 2.71, 2.31, 2.32; 381/29–46; 375/243

[56] References Cited

U.S. PATENT DOCUMENTS

| | | | |
|---|---|---|---|
| 5,206,884 | 4/1993 | Bhaskar | 341/51 |
| 5,327,520 | 7/1994 | Chen | 395/2.28 |
| 5,384,891 | 1/1995 | Asakawa et al. | 395/2.29 |
| 5,450,522 | 9/1995 | Hermansky et al. | 395/2.2 |

OTHER PUBLICATIONS

K.K. Paliwal et al, "Efficient Vector Quantization Of LPC Parameters At 24 Bits/Frame," *IEEE Trans. Speech Audio Process.*, vol. 1, No. 1, 1993, pp. 3–14.

W.B. Kleijn et al, "A General Waveform Interpolation Structure For Speech Coding," *Signal Processing VII*, Theories And Applications (Proc. of EUSIPCO 94), pp. 1665–1668.

J.S. Erkelens et al., "Analysis Of Spectral Interpolation With Weighting Dependent On Frame Energy," *Proc. ICASSP* Adelaide, 1994, pp. I–481–I–484.

J.S. Erkelens et al, "Interpolation Of Autoregressive Processes At Discontinuities: Application To LPC Based Speech Coding," *Signal Processing VII* Theories And Applications (Proc. of EUSIPCO 94), pp. 935–938.

B.S. Atal et al, "Spectral Quantization and Interpolation For Celp Coders," *Proc. ICASSP*, Glasgow, 1989, pp. 69–72.

*Primary Examiner*—Douglas W. Olms
*Assistant Examiner*—Ajit Patel
*Attorney, Agent, or Firm*—Kenneth M. Brown

[57] ABSTRACT

A decoding method and apparatus for speech coding systems which takes into account the fact that the human auditory system is sensitive to changes in signal characteristics. For example, a sustained distortion of the spectral characteristic of reconstructed speech is usually less perceptible than an objectively smaller distortion which changes as a function of time. This property of the auditory system is advantageously exploited in the design of a speech coding system receiver in accordance with the present invention, by selecting the sequence of decoded speech parameter values on a perceptual basis. Illustratively, the sequence of decoded speech parameter values is selected so as to describe a smooth path through the sequence of Voronoi regions. The distance between successive parameter values is advantageously minimized, under the constraint that the resultant parameter values fall within, or nearly within, the appropriate Voronoi regions. In this manner, a smoother trajectory will result, thereby enabling the receiver to produce a perceptually superior reconstructed speech signal.

16 Claims, 4 Drawing Sheets

SPEECH CODING PARAMETER SMOOTHING METHOD

FIELD OF THE INVENTION

The present invention is generally related to speech coding systems and more specifically to a method for improving the perceptual quality of such systems.

BACKGROUND OF THE INVENTION

Speech coding systems operate by generating an encoded representation of a speech signal for communication over a channel or network to one or more system receivers (i.e., decoders). Each system receiver reconstructs the speech signal by decoding the received signal. The quantity of information communicated by the system over a given time period defines the system bandwidth and affects the quality of the reconstructed speech. The objective of most speech coding systems is to provide the best trade-off between reconstructed speech quality and system bandwidth, given various conditions such as the signal quality of the input speech (i.e., the original speech signal which is to be coded), the quality of the communications channel itself, bandwidth limitations, and cost.

The speech signal is commonly represented by a set of parameters which are quantized for transmission. These parameters may be either scalar or vector parameters. In many typical system encoders, a lookup is performed in a preconstructed table (commonly referred to as a codebook) in order to identify the table entry which best matches the parameter to be coded. Then, the index (i.e., the entry number) of the best matching codebook entry is transmitted to the receiver(s) for decoding. In a conventional receiver, an identical codebook to the one contained in the transmitter (i.e., the encoder) is used to reconstruct the parameter values from the transmitted indices, by retrieving the entries identified by each transmitted index. Upon retrieval of the parameter values, they are often interpolated and the resulting upsampled parameter sequence is provided as input to the speech synthesis portion of the speech decoder.

In order to produce an effective speech coding system, it is important that the values of the decoded parameters are reasonably close to their original values. This, however, does not necessarily mean that the decoded parameter values should in every case be as close as possible to the original values. Rather, it is the perceived characteristics of the decoded parameters which are important. Thus, the perception of the reconstructed speech should advantageously be as close as possible to that of the original speech. For example, it is often the case that the dynamic characteristics of a speech coding parameter play a major role in the perception of the reconstructed speech. However, conventional decoders strive only to minimize the difference between the values of the decoded parameters and their original values, ignoring such perceptual considerations.

SUMMARY OF THE INVENTION

The present invention provides a modified decoding method and apparatus for speech coding systems which takes into account the fact that the human auditory system is particularly sensitive to changes in signal characteristics. For example, a sustained distortion of the spectral characteristic of reconstructed speech is usually less perceptible than an objectively smaller distortion which changes significantly over time. This property of the auditory system is advantageously exploited in the design of a speech coding system receiver in accordance with the present invention.

Specifically, in accordance with an illustrative embodiment of the present invention, the sequence of decoded parameter values is selected on a perceptual basis. In particular, the sequence of decoded parameters values is selected so as to describe a smooth path through the sequence of Voronoi regions. (As is known to those skilled in the art, the Voronoi region for a given quantized value is the region of values within which the original unquantized value must have been located.) In this illustrative embodiment, the distance between successive parameter values is advantageously minimized under the constraint that the resultant parameter values fall within, or nearly within, the corresponding Voronoi regions. In this manner, a smoother trajectory of decoded parameter values will be generated, thereby enabling the receiver to produce a perceptually superior reconstructed speech signal.

BRIEF DESCRIPTION OF THE DRAWINGS

" FIG. 1A shows original, unquantized trajectories; FIG. 1B shows quantized trajectories; and FIG. 1C shows trajectories which have been smoothed in accordance with an illustrative embodiment of the present invention.

FIG. 4A shows an original, unquantized trajectory; FIG. 4B shows a quantized trajectory; and FIG. 4C shows a trajectory which has been smoothed in accordance with an illustrative embodiment of the present invention.

FIG. 6B shows spectral steps of unquantized LSF parameters; FIG. 6C shows spectral steps of quantized LSF parameters; FIG. 6D shows spectral steps of filtered LSF parameters; and FIG. 6E shows spectral steps of smoothed LSF parameters in accordance with an illustrative embodiment of the present invention.

DETAILED DESCRIPTION

Introduction

Figure 1A:
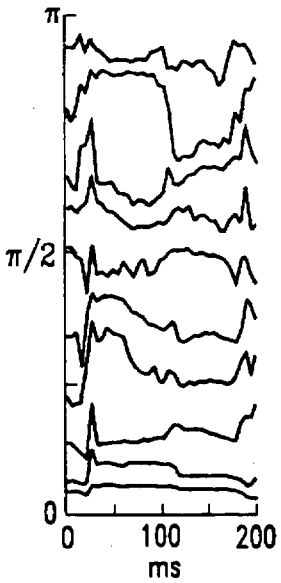
FIGS. 1A–1C show illustrative line spectral frequency (LSF) trajectories for the word "dune.

Specifically, the illustrative embodiment of the present invention described herein comprises a method of decoding codebook indices obtained by the receiver of a speech coding system. In a conventional speech decoder, the codebook index refers to a particular parameter value entry of the codebook, and this value is used by the decoder as the resultant parameter value. (In the context of the present invention, parameter values may comprise scalar values, vector values or both.) In contrast, in accordance with the illustrative embodiment of the present invention, the resultant decoded value for a particular received index may also depend on indices received before and/or after the particular index being decoded.

During quantization of parameters by an encoder, the value selected from the codebook is the one nearest to the unquantized value, according to some predetermined objective measure. Based on this predetermined measure, therefore, a region of values in which the unquantized parameter value must have been located can be defined around each quantized value. As is known to those skilled in the art, this region is called the Voronoi region, and the quantized value is referred to as the "centroid" of the region. (Note that if the unquantized parameter were to have fallen outside this region, then a different quantized value would necessarily have been selected.) Thus, just as each transmitted index can be associated with a particular quantized value or centroid, each transmitted index can alternatively be associated with a particular Voronoi region as a whole. Since the original parameter values necessarily fall within the Voronoi regions associated with the transmitted indices, it is advantageous to constrain the decoded values to fall within these same Voronoi regions. Thus, a sequence of decoded parameter values should generally be considered to fall within a sequence of Voronoi regions.

A smooth path through this sequence of Voronoi regions can be obtained by means of an illustrative embodiment of the present invention which minimizes the distance between successive decoded parameter values under the constraint that the decoded parameter values fall within the corresponding Voronoi regions. However, since it is computationally burdensome to define the multi-faceted Voronoi regions accurately, the Voronoi regions may advantageously be approximated as a hypersphere. Moreover, it benefits the computational tractability of the procedure if it is merely very unlikely, rather than impossible, that a particular decoded parameter value is selected to be outside the Voronoi region corresponding to the received index.

Specifically, the determination of a smooth parameter value sequence in accordance with the illustrative embodiment of the present invention can be accomplished with an iterative procedure which is based on the conceptual application of a set of "forces." In particular, the initially selected parameter values are chosen based solely on the values contained in the codebook (as selected based on the transmitted codebook index). Then, at each of a series of iterations, each parameter value in a sequence thereof is updated by subjecting its value to a set of conceptual forces—namely, an attraction towards each of the previous and subsequent parameter values of the parameter sequence, and an attraction towards the centroid of the Voronoi region corresponding to the transmitted codebook index. For each such iteration, therefore, each of the parameter values in a sequence segment are thereby moved slightly in the direction of the resultant (overall) force. After a modest number of iterations, a smooth trajectory of parameter values will result. The procedure can be advantageously applied to successive segments of the sequence of parameter values to allow real-time operation.

The illustrative embodiment of the present invention described herein may be applied in particular to linear-prediction coefficients (LPCs). The technique of linear prediction (LP), well known to those skilled in the art, is used in many speech coding systems. Its primary function is to provide a representation of the power-spectrum envelope. For many low-bit-rate coders, the linear-prediction coefficients require a significant share (often 50%) of the overall bit rate. Thus, efficient coding of the linear-prediction coefficients is of great practical importance to speech coding and much work has been devoted to improving quantizer performance.

A static measure is generally used to evaluate the performance of the quantizers. For example, one such measure evaluates the root-mean square (rms) distance between the log-power spectrum corresponding to the original linear-prediction coefficients for a frame i, $P_i(\omega)$, and the log-power spectrum corresponding to the quantized linear-prediction coefficients, $\hat{P}_i(\omega)$. Specifically, this distance is $$SD = \left( \frac{1}{2\pi} \int_{-\pi}^{\pi} [\ln(P_i(\omega)) - \ln(\hat{P}_i(\omega))]^2 d\omega \right)^{1/2}. \quad (1)$$

It is commonly accepted that a mean value of 1 dB for spectral distortion corresponds to transparent speech quality. (See, e.g., K. K. Paliwal and B. S. Atal, "Efficient Vector Quantization of LPC Parameters at 24 Bits/Frame", IEEE Trans. Speech Audio Process., vol. 1, no. 1, pp. 3–14, 1993.) However, for a small segment of speech, the mean value of spectral distortion is generally not very indicative of the perceived distortion. In fact, a segment with a spectral distortion of 1 dB may have relatively low quality and a segment with a spectral distortion of 3 dB may have relatively high quality. One reason for this is that the assumption that a static measure accurately represents perceived distortion is incorrect because it ignores the dynamics of the power-spectrum envelope. This implies that the efficiency of existing quantizers can be increased by taking these dynamics into account.

Note that the static measure can be considered an indirect measure of the dynamics of the reconstructed signal when conventional quantizers are used. In the conventional interpretation the mean of the static measure determines the mean distance between the quantized and the unquantized power-spectrum envelope. However, because of the high effective dimensionality of the space of the linear-prediction coefficients (which is approximately 7), the mean of the static measure is very similar in value to the mean distance between adjacent quantized spectra in the codebook. Thus, the mean of the static measure also provides an estimate of the step size between successive, quantized power-spectrum envelopes (assuming conventional quantization procedures).

Although the dynamics of the power-spectrum envelope is not typically taken into account by conventional quantization procedures, it is commonly considered in another aspect of linear-prediction-based coding. Specifically, most low-bit-rate coders have an update rate of the linear-prediction coefficients which is between 33 and 100 Hz. In order to bridge the difference between successive updates, the linear-prediction coefficients are generally interpolated on a subframe-by-subframe basis, where a subframe is typically between 2.5 and 7.5 ms in length. A good interpolation of the linear-prediction coefficients results in a perceptually reasonable evolution between transmitted power-spectrum envelopes. For example, linear interpolation of the line spectral frequencies (LSFs) usually leads to a smoothly evolving power-spectrum envelope, as is desirable. Interpolation methods which result in excursions of the power-spectrum envelope, however, are clearly not desirable. Generally, a good method for linear-prediction-coefficient interpolation maintains the original dynamics of the power-spectrum envelope. The results obtained with the static distortion measure and linear-prediction-coefficient interpolation point towards the importance of the dynamics of the power-spectrum envelope for subjective speech quality.

In many speech coders, the linear-prediction coefficients are quantized using memoryless quantization approximately once every 20 to 30 ms. The quantization introduces noise in the parameters which manifests itself as an increased rate of change of the power-spectrum envelope. Because the average distance between adjacent sets of quantized linear-prediction coefficients decreases with increasing quantizer performance, this increase in the rate of change is smaller for better quantizers. Thus, a static performance measure has a strong correlation with the rate of change of the power-spectrum envelope.

A plot of the spectral distortion as a function of time typically shows peaks with a magnitude of many times the mean of the spectral distortion. Often however, speech segments of high subjective distortion in fact have a low spectral distortion. Similarly, speech segments of low subjective distortion often have a high spectral distortion. High subjective quality in spite of high spectral distortion usually corresponds to regions of speech with rapid changes of the power-spectrum envelope. In such a case, the quantization noise (i.e., error) is most likely masked by the rapid change of the power-spectrum envelope. It can also be determined that speech segments with a low spectral distortion measure are, in fact, often a major source of subjective distortion caused by linear-prediction-coefficient quantizers. Typically this type of distortion occurs in vowels of long duration, where the power-spectrum envelope is relatively constant. This is most likely due to the fact that biological receptor systems are sensitive to small changes in an otherwise steady-state situation.

The LSFs are commonly used for quantization and have desirable interpolation properties. They provide a good low-dimensional representation of the power-spectral envelope. For example, when the power-spectral envelope is relatively constant, the LSFs are relatively constant as well. In the following discussion of an illustrative embodiment of the present invention, the LSF representation is used as the representation of the power-spectral envelope, but other good representations of the spectrum may be used in alternative embodiments.

Estimation errors in the LP analysis will introduce some noise in the estimated power-spectral envelope. One reason for estimation errors is nonpitch-synchronous analysis. A typical trajectory (for the spoken word "dune") of the LSF is shown in FIG. 1A. The linear-prediction analysis was performed every 20 ms. (Note that a re-analysis of the signal with a 10 ms offset, for example, would maintain the general shape of the trajectory, but with different local variations.)

Figure 1B:
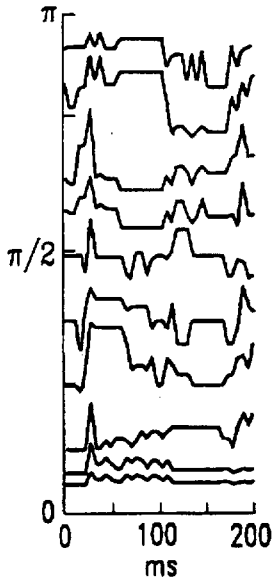

When the LSF values are quantized by an encoder, the unquantized value is mapped to the quantized value (i.e., the centroid). Any unquantized value falling within the Voronoi region associated with a particular centroid will be mapped to that centroid. Thus the boundaries of the Voronoi regions (the Voronoi facets) form a partition of the space associated with the quantized values. FIG. 1B shows the LSF trajectories of FIG. 1A after conventional quantization. Note that the quantization results in increased variations of the power-spectral envelope. When an original parameter (e.g., an LSF) is close to a Voronoi facet, small parameter variations are likely to cause the quantizer to switch between indices of neighboring quantized values. An example of this effect is clearly visible for the 9th LSF in FIG. 1A and FIG. 1B.

In high resolution quantizers, switching between neighboring centroids will result in small changes in the power-spectral envelope of the reconstructed speech. However, for coarse (i.e., low resolution) quantizers the switching between neighboring centroids often results in relatively large changes in the power-spectral envelope, and thus may result in a significant amount of perceived distortion. With conventional decoding techniques, the only solution to this problem is to use higher resolution quantizers. However, the realization that it is the incorrectly reconstructed rate of change of the power-spectral envelope, rather than the absolute error of the power-spectral envelope, which causes much of the subjective distortion, suggests that more efficient decoding procedures may exist, forming a motivation for the present invention.

Since the reconstruction of the power-spectral envelope dynamics is important to reconstructed speech quality, it must be considered carefully in the design of a speech coder. To counteract the increase in the rate of change of the power-spectral envelope caused by the quantization process, a power-spectral envelope smoothing process advantageously may be used. This smoothing process can exploit both characteristics of human perception and the properties of the quantizer. During the quantization process, for example, each original power-spectral envelope may be mapped into a quantized power-spectral envelope which corresponds to the centroid of a Voronoi region in the parameter domain. That is, all unquantized parameters within a Voronoi region may be mapped to the centroid. Thus, when a certain quantization index is used for reconstruction, it is known by the decoder that the original parameter was located within the Voronoi region associated with the centroid corresponding to that index. A smoothing procedure advantageously constrains the reconstructed parameters to fall within the same Voronoi region as the original parameter.

A number of techniques for smoothing the power-spectral envelope at the decoder may be employed in accordance with various illustrative embodiments of the present invention. For example, one can use straightforward low-pass filtering of the differential LSF. One apparent disadvantage of this method is that the formants, particularly formants at higher frequencies, may be displaced from their original locations. However, it has been found that this displacement is typically not of perceptual significance, while the resulting spectral evolution smoothing results in improved quality of the reconstructed speech. In general, low-pass filtering of the differential LSF improves the reconstructed speech quality in regions where the original power-spectral envelope changes slowly, due to the importance of the effect of quantization on the dynamics of the power-spectral envelope.

Note that the filtering procedure does not satisfy the constraint that the reconstructed parameters necessarily fail within the same Voronoi region as that of the original power-spectral envelope. This is particularly true for rapid onsets, which may be smoothed in an undesirable manner by filtering. That is, whereas filtering improves the subjective speech quality in steady-state regions, it may decrease the quality for transitions. To prevent this disadvantageous effect, the preferred illustrative embodiment of the present invention performs smoothing under the constraint that the original and reconstructed power-spectral envelope fall within the same Voronoi regions.

Illustrative speech coding system embodiment

Figure 2:
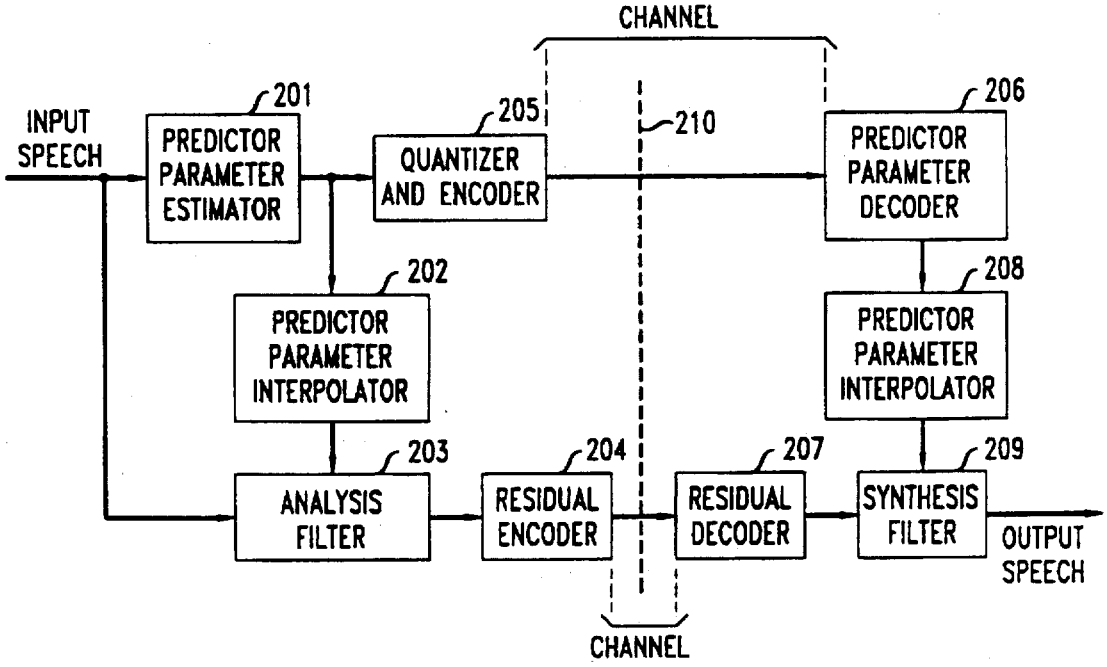
FIG. 2 shows an illustrative embodiment of a speech coder (including both the transmitter and the receiver portions) which may advantageously employ the principals of the present invention.

FIG. 2 presents an illustrative embodiment of a speech coder (including both the transmitter and the receiver portions) which may employ the principals of the present invention as described above. The original speech signal provides the input to predictor parameter estimator 201, which performs a conventional linear-predictive analysis. This analysis may, for example, be performed repetitively, once every 20 to 30 ms. The output of the linear-predictive analysis is a set of linear-predictor coefficients, which are quantized and encoded by quantizer and encoder 205 using conventional procedures. (See, e.g., K. K. Paliwal and B. S. Atal, "Efficient Vector Quantization of LPC Parameters at 24 Bits/Frame," IEEE Trans. Speech Audio Process., vol. 1, no. 1, pp. 3–14, 1993).

The predictor coefficients are interpolated on a subframe by subframe basis in predictor parameter interpolator 202. The subframes may, for example, be approximately 2 to 7 ms in length. The interpolation may be performed in a transform domain of the linear-prediction coefficients, such as the above-described LSFs, which have more desirable interpolation properties than the LP coefficients themselves. The interpolated predictor coefficients are then used to filter the input speech with an all-zero filter, analysis filter 203, which removes short-term correlations from the input speech signal. The resulting output signal is commonly called the residual signal. The residual signal can be encoded in any of a number of conventional ways known to those skilled in the art. For example, one particular method of encoding the residual signal is by means of waveform-interpolation, as is described in W. B. Kleijn and J. Haagen, "A general waveform interpolation structure for speech coding," Signal Processing VII, Theories and Applications (Proc. of EUSIPCO 94), edited by M. J. J. Holt, C. F. N. Cowan, P. M. Grant, and W. A. Sandham, pp. 1665–1668, 1994.

Indices describing the encoded linear-prediction coefficients and the encoded residual are transmitted across channel 210 and received in predictor parameter decoder 206 and residual decoder 207. In predictor parameter decoder 206, the transmitted indices for the linear prediction coefficients are mapped into sets of predictor coefficients. As in the transmitter, these predictor coefficients are interpolated on a subframe by subframe basis in predictor parameter interpolator 208, which may be identical to predictor parameter interpolator 202. The predictor coefficients obtained from predictor parameter interpolator 208 are used to define an all-pole linear-prediction synthesis filter, synthesis filter 209.

Residual decoder 207 constructs a linear-predictive excitation signal. This excitation signal provides the input for (LP) synthesis filter 209. The output of synthesis filter 209 is the reconstructed speech signal (i.e., the output speech signal).

Note that in the illustrative embodiment of FIG. 2, analysis filter 203 uses the unquantized linear-prediction coefficients. In many coders, the analysis filter uses the quantized linear-prediction coefficients instead. The principals of the present invention may advantageously be employed with either implementation of a linear-prediction based speech coder.

Residual encoder 204 may use speech-based criteria. That is, the properties of synthesis filter 209 may be taken into account during the encoding of the residual signal. Quantization of the residual signal using such speech-based criteria is usually called closed-loop or analysis-by-synthesis optimization. Since the techniques of the present invention employ a predictor parameter decoder and a synthesis filter which differ from those of prior art decoders, these changes will need to be accounted for in a corresponding residual encoder if analysis-by-synthesis coding is used. Adapting the techniques of the present invention as disclosed herein to such analysis-by-synthesis coding systems will be obvious to those skilled in the art.

Illustrative predictor parameter decoder with constrained smoothing

Figure 3:
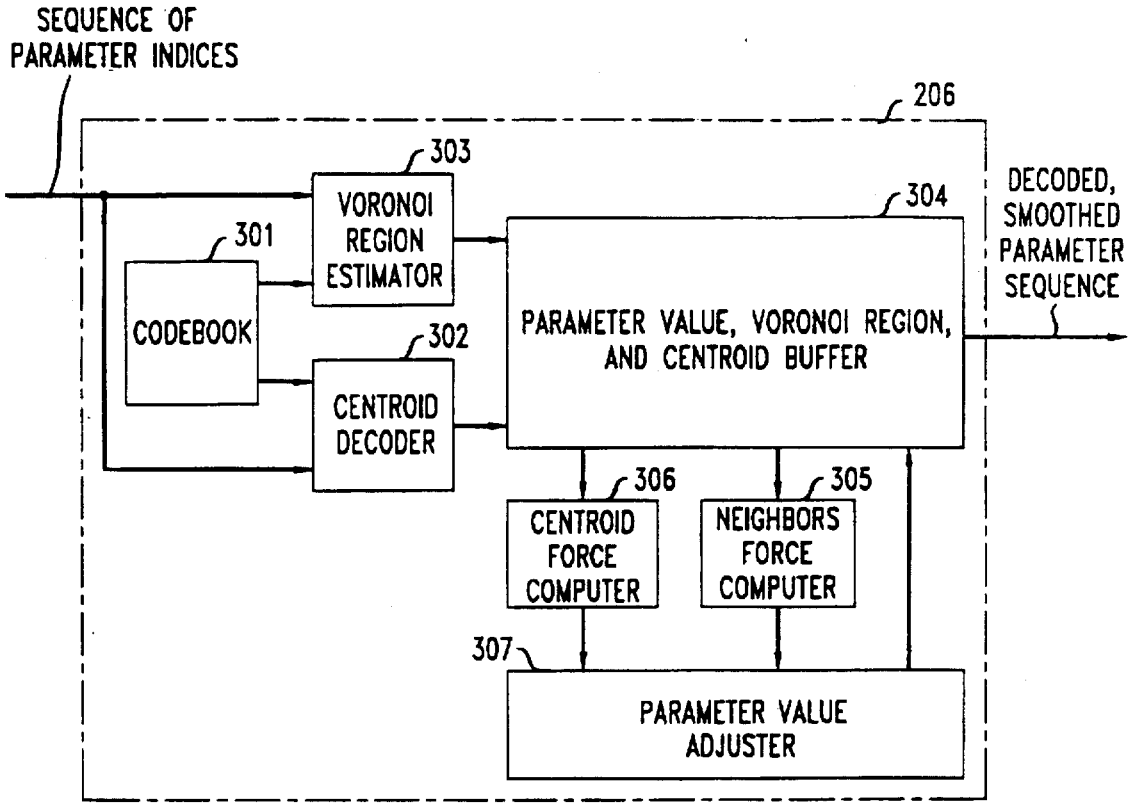
FIG. 3 shows an illustrative implementation of the predictor parameter decoder of the receiver of FIG. 2 providing constrained smoothing in accordance with an illustrative embodiment of the present invention.

FIG. 3 shows an illustrative implementation of predictor parameter decoder 206 providing constrained smoothing. The input signal to the parameter decoder comprises a sequence of parameter indices as they are received from the transmitter over the channel. Generally, for a particular parameter (which, as pointed out above, may be a vector parameter), one codebook index arrives per frame or subframe. For linear prediction parameters in particular, one codebook index arrives per frame. Centroid decoder 302 may be a conventional decoder which selects a particular parameter value (i.e., the centroid) from conventional codebook 301. (In a conventional speech decoding system, this centroid is the final decoded value for the parameter.)

In the illustrative predictor parameter decoder of FIG. 3, Voronoi region estimator 303 generates a representation of the Voronoi region associated with the centroid which was selected by centroid decoder 302. Both the Voronoi region representation and the centroid are provided as inputs to buffer 304. Buffer 304 stores, for each of a number (e.g., N) of sequential updates, three parameter attributes—the Voronoi region representation, the centroid, and the parameter value itself. The values are shifted forward through the buffer at each iteration (i.e., whenever a new update is entered), and the parameter value of the oldest update becomes the output signal value from buffer 304. Each initial parameter value is set equal to the centroid. In this manner, while the attributes corresponding to a given update remains in the buffer, the parameter value is adjusted so as to effect a constrained smoothing of the parameter trajectory across sequential parameter values. In particular, this constrained smoothing of the parameter values is performed by centroid force computer 306, neighbors force computer 305, and parameter value adjuster 307.

Specifically, the constrained smoothing is performed in an iterative manner. Of the N updates stored in the buffer, N–2 updates are adjusted for each iteration—the first and the last values are not updated, because, in each case, one of the "neighboring" parameter values (i.e., either the previous or the subsequent parameter value) is unavailable. Advantageously, several iterations are performed between changes of the contents of buffer 304.

It is convenient to conceptualize the iterative process as mimicking a physical interaction between point-like particles which are located in a geometric space at each of the parameter values (which thus form the coordinates of the particle location). The first step for each iteration of the constrained smoothing method is to compute the "attractive force" between particles representing subsequent updates in neighbors force computer 305. This attractive force attempts to shorten the distance between sequential parameter values, resulting in a smoothing of this sequence.

If only the attractive forces between successive parameter values were used, the parameter value sequence would have the tendency to collapse to a single value. The constraint that the parameter values be maintained within the Voronoi regions associated with the transmitted index prevents this from happening. This constraint is effectuated by centroid force computer 306. Centroid force computer 306 computes the strength of a force towards the centroid associated with the transmitted index. This force may be advantageously weak within the Voronoi region but very strong outside of the Voronoi region, thus making it highly unlikely that the parameter values will stray outside their corresponding Voronoi regions. It is this force which effectively implements the Voronoi region constraint on the smoothing procedure.

The sum of the forces on each parameter value is computed in parameter value adjuster 307. The parameter value is then adjusted in the direction of the resultant force. (That is, the value is modified in the direction of and by an amount commensurate with the calculated force.) Performing this procedure iteratively for all but the first and last values contained in the buffer results in a constrained smoothing of the track followed by the sequence of parameter values.

For a real-time implementation, it is advantageous to make buffer 306 as short as possible, since the length of buffer 306 corresponds to an additionally incurred decoding delay. In addition, it can be seen that the oldest parameter value in the buffer may be output prior to the initiation of a set of iterations. Since the oldest and newest parameter values in the buffer are not changed during a given iteration, the minimum possible length of the buffer is clearly 3 updates. Whereas increased buffer length will improve the performance of the decoder, even short buffer lengths can provide significant improvements over conventional techniques. For the case of the linear-prediction coefficients, for example, the use of a buffer length of 4 parameter values results in a real-time implementation which provides such improvements over conventional decoding techniques without introducing excessive delay.

Figure 1C:
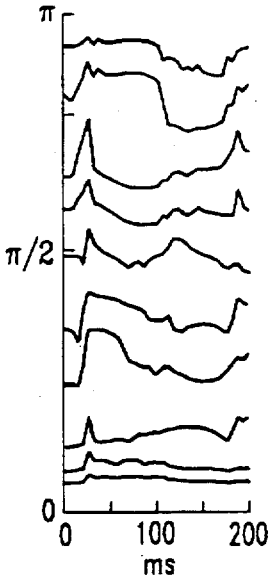
Figure 4A:
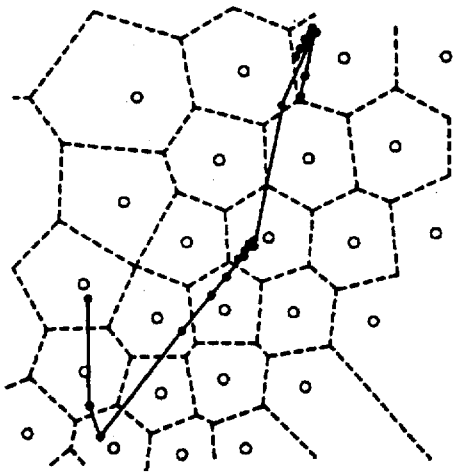
FIGS. 4A–4C show illustrative Voronoi regions, corresponding centroids and LSF trajectories in the $LSF_1$–$LSF_2$ plane for a 2-3-5 split VQ using 6 bits in each block.
Figure 4B:
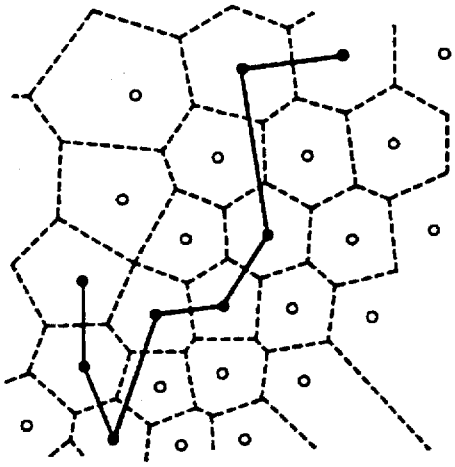

FIG. 4A shows an illustrative trajectory of the original LSF in the $LSF_1$–$LSF_2$ plane, for a 2-3-5 split VQ and the spoken word "dune" for which all LSF trajectories are displayed in FIGS. 1A–1C. The figure also shows the centroids (as small circles) and the corresponding Voronoi regions (outlined by dashed lines) of the quantizer. The original parameter values (before quantization) are shown as dots (i.e, filled-in circles). The corresponding quantized trajectory is shown in FIG. 4B, where the dequantized parameter values coincide with the centroids (and thus are also shown as dots). Note that many of the steps between successive LSF parameters are significantly larger in the quantized case as shown in FIG. 4B than in the original case as shown in FIG. 4A, while other steps vanish completely. The result of the illustrative constrained smoothing procedure as described in further detail below is shown in FIG. 4C (where the decoded parameter values are also shown as dots).

Figure 4C:
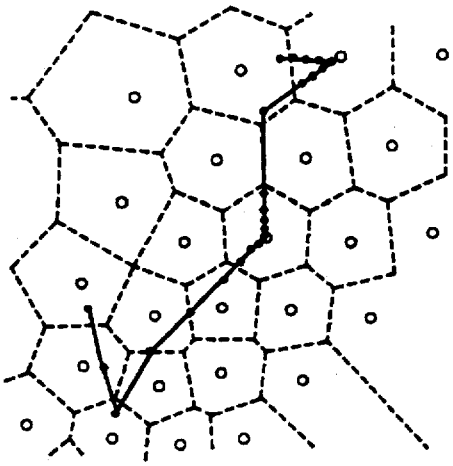

In the case of FIGS. 4A–4C, each parameter is represented as a two-dimensional vector (which, as mentioned before, can be interpreted as a particle location). These vectors will be referred to as $r_i$, where i is the update index. The forces are defined such that, in equilibrium, a) the distances between adjacent $r_i$ are small (ensuring a smooth trajectory), and b) the constraint that each point remains within the Voronoi region is reasonably well satisfied.

The attractive force between subsequent parameter values may advantageously be set to be proportional to the distance between the parameters, thereby leading to a desirable smoothing effect. Specifically, let $F_{i,i+1}$ be the force on $r_i$ from $r_{i+1}$. The force may then be defined as $$F_{i,i+1} = \gamma \cdot \frac{r_{i+1} - r_i}{R}, \tag{2}$$

where R is a distance scaling factor. The value of R may, for example, be selected based on the size of the corresponding Voronoi region (e.g., $R=R_{max}$, where $R_{max}$ is as defined below).

In addition to the forces between adjacent parameter values, each parameter is subject to a force pulling towards the centroid, implementing the constraint. A weak force ($\alpha$) is present if the parameter value is inside the Voronoi region. This ensures that the parameter value moves towards the centroid if no neighboring parameter values are within another Voronoi region. The centroid force is strong ($\beta$), however, if the parameter value is outside the Voronoi region. Moreover, in this illustrative embodiment the Voronoi region may be approximated by the largest hypersphere centered at the centroid which may be inscribed therein. Let it have radius $R_{max}$. Then, the centroid force is:

$$F_{i,c} = k \cdot \frac{y_c - r_i}{|y_c - r_i|}, \tag{3}$$

where $y_c$ is the centroid vector, and where $$k=\alpha \text{ if } |y_c - r_i| < R_{max}, \text{ and } k=\beta, \text{ otherwise.}$$

The overall force operating on each parameter value may be computed simply as the sum of all of these forces:

$$F_i = F_{i-1,i} + F_{i+1,i} + F_{i,c}. \tag{4}$$

Figure 5:
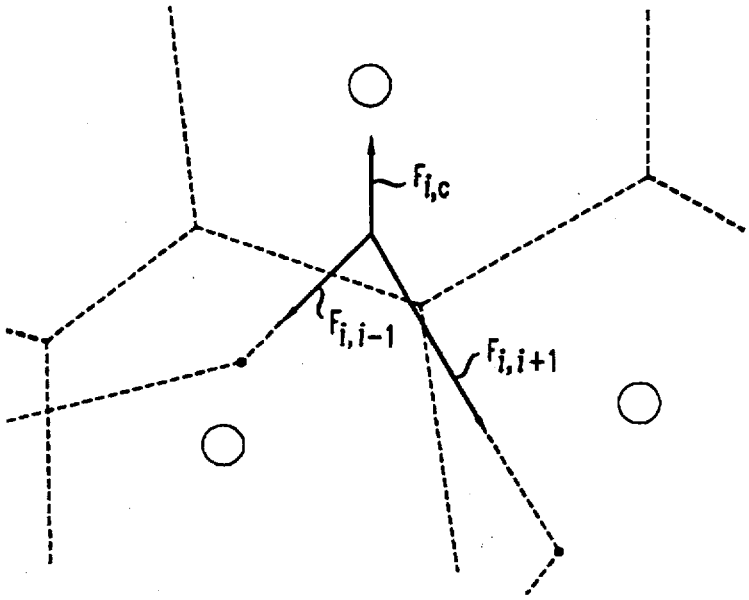
FIG. 5 illustrates the application of (conceptual) "forces" on the "i'th" reconstruction vector in accordance with an illustrative embodiment of the present invention.

An example of the three forces being simultaneously applied to a given parameter is illustratively shown in FIG. 5.

In accordance with an illustrative embodiment of the present invention, a near-equilibrium situation may be obtained by means of an iterative procedure. Specifically, the procedure moves each parameter value once per iterative loop. For each change in parameter value, the overall force is evaluated and the reconstructed parameter is moved in the direction of the net force, over a distance proportional to the strength of the force. For reasonable settings of the "constants" $\alpha$, $\gamma$, and $\beta$, the procedure converges rapidly. In particular, the relative magnitudes of the forces may be adjusted in an advantageous manner by ensuring that $\alpha<\gamma<<\beta$. For example, these constants may illustratively be set as follows: $\alpha=0.08$, $\gamma=1$, and $\beta=8.0$.

Figure 6A:
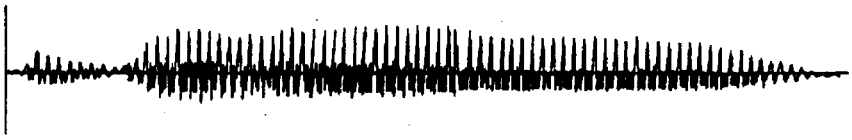
FIG. 6A shows an illustrative acoustic waveform which may be quantized and subsequently smoothed in accordance with an illustrative embodiment of the present invention.
Figure 6B:
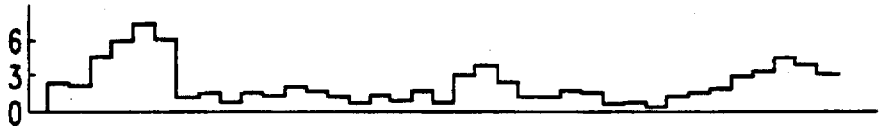
FIGS. 6B–6E show spectral steps of adjacent frames of LSF parameters corresponding to the waveform of FIG. 6A.
Figure 6C:
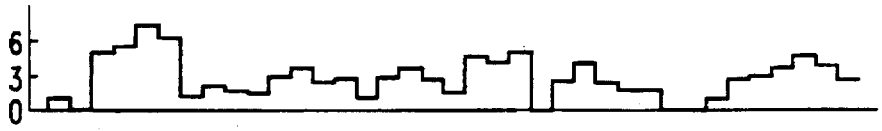
Figure 6D:
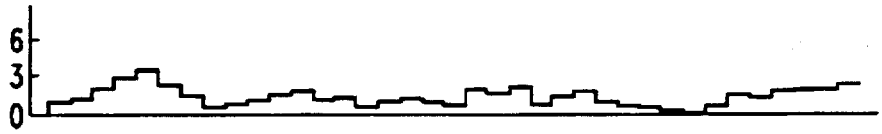
Figure 6E:
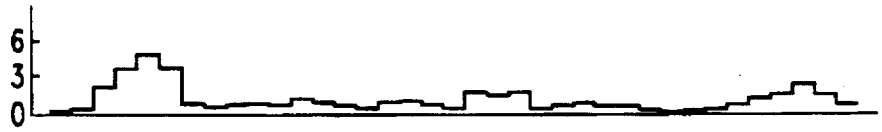

To illustrate the effects of the constrained smoothing procedure described above, FIG. 6A shows an illustrative acoustic waveform which has be quantized and subsequently smoothed in accordance with an illustrative embodiment of the present invention. The time signal shown in FIG. 6A has been quantized using a coarse quantizer. The LP-residual has been computed using the unquantized LP coefficients and the speech signal has been reconstructed using the quantized LP coefficients. The LP update rate is 50 Hz and the LP coefficients have been interpolated in the LSF domain using 5 ms subframes. To evaluate the spectral evolution the spectral steps are measured as $$\Delta PSE = \left( \frac{1}{2\pi} \int_{-\pi}^{\pi} [\ln(P_{i+1}(\omega)) - \ln(P_i(\omega))]^2 d\omega \right)^{1/2}, \tag{5}$$

where PSE denotes the power-spectral envelope. The spectral steps before and after quantization are illustratively shown in FIGS. 6B and 6C, respectively. Note that the spectral steps after quantization mimic those before quantization in transient regions, but are significantly larger in the steady-state regions. The mean spectral step over the utterance is 2.2 dB and 2.9 dB for the unquantized and quantized power-spectral envelopes, respectively. The spectral distortion due to quantization is 2.2 dB. The result of filtering of the LSF parameters (using a 4-tap FIR filter with cut-off frequency of 12.5 Hz) is shown in FIG. 6D. Note that the performance is enhanced in the steady state regions, but this enhancement is obtained at the cost of smearing out regions with large spectral steps. The result of performing the above described smoothing procedure in accordance with an illustrative embodiment of the preset invention is shown in FIG.

6E. Note that the step size is essentially preserved in the transition region while the step size is quite small in the steady-state region. The slightly smaller step size than that observed before quantization is the result of the removal of small variations. As described above, these variations in the original LSF parameters may, in fact, be caused by estimation errors.

The results achieved by the above described illustrative embodiment are further illustrated in FIGS. 1A–1C. FIG. 1A shows the dynamics of the original LSF parameters (in radians), $LSF_i$, i=1 . . . 10, whereas FIG. 1B shows the behavior of the same set of LSF parameters after quantization with a 15-bit split-VQ quantizer. The quantizer has a 3-3-4 split and an equal number of bits for each block. Note that the rate of change of the LSF trajectories is increased by the quantization process. It is this rate of change that the constrained smoothing technique advantageously reduces. Perceptually most important in FIG. 1B is the evolution over time of the first three coefficients $LSF_1$, $LSF_2$, and $LSF_3$, which represent a low-frequency formant. The coefficients are close and noisy, which causes the formant to vary both in frequency and bandwidth. FIG. 1C shows the effect of the above described illustrative smoothing technique with $\alpha$=0.08, $\gamma$=1, and $\beta$=8.0. Note that the resulting LSF trajectories match those of the original parameters shown in FIG. 1A quite well, considering that they have been derived from the LSF trajectories shown in FIG. 1B.

The use of the illustrative constrained spectral evolution smoothing technique, in accordance with the principles of the present invention, results in a significant improvement of the subjective quality in steady state regions. Note also, however, that the constrained smoothing technique does not degrade the transitions. In certain cases the improvements may also be visible on graphically displayed speech signals. Using an unsmoothed, coarse quantizer can lead to excursions of the filter gain. When this occurs for the dominant formants, the energy contour of the output signal becomes uneven. These visible quantization artifacts may also be advantageously removed with use of an illustrative smoothing technique in accordance with the principles of the present invention.

Although a number of specific embodiments of this invention have been shown and described herein, it is to be understood that these embodiments are merely illustrative of the many possible specific arrangements which can be devised in application of the principles of the invention. Numerous and varied other arrangements can be devised in accordance with these principles by those of ordinary skill in the art without departing from the spirit and scope of the invention. For example, although the above described embodiments have involved the coding of certain speech parameters such as LPC parameters and line spectral frequencies, it will obvious to those skilled in the art that the techniques of the present invention may be applied to coding systems involving the coding of other speech signal parameters as well. Moreover, although the above described embodiments have been directed to a method for use in the decoding of coded speech signals, it will be obvious to those skilled in the art that the techniques of the present invention may also be applied to the coding of other signals such as audio signals, image signals or video signals.

We claim:

1. A method for use in a communications system decoder, the method for decoding a sequence of coded parameter signals to generate a decoded parameter signal corresponding to one of the coded parameter signals, each coded parameter signal representative of a quantized value associated with a corresponding one of a sequence of parameters, the method comprising the steps of:

determining an initial parameter value for the decoded parameter signal based on the quantized value represented by the coded parameter signal corresponding to the decoded parameter signal;

determining a parameter value to be associated with another one of the coded parameter signals based on the quantized value represented thereby; and generating the decoded parameter signal based on the initial parameter value and the parameter value associated with the other one of the coded parameter signals, wherein the decoded parameter signal has a value such that a distance between the value of the decoded parameter signal and the parameter value associated with the other one of the coded parameter signals is less than a distance between the initial parameter value and the parameter value associated with the other one of the coded parameter signals.

2. The method of claim 1 wherein the coded parameter signal corresponding to the decoded parameter signal and the other one of the coded parameter signals are consecutive coded parameter signals in the sequence thereof.

3. The method of claim 2 wherein the decoded parameter signal is generated further based on the quantized value represented by a second other one of the coded parameter signals, wherein the coded parameter signal corresponding to the decoded parameter signal and the second other one of the coded parameter signals are also consecutive coded parameter signals in the sequence thereof.

4. The method of claim 1 wherein the step of generating the decoded parameter signal comprises performing an iterative procedure comprising a plurality of iterations, a first one of the iterations comprising modifying the initial parameter value to produce a first one of a sequence of updated parameter values, the sequence of updated parameter values corresponding to the plurality of iterations, the modifying step of the first iteration based on the quantized value represented by the other one of the coded parameter signals, and each iteration subsequent to the first iteration comprising modifying the updated parameter value produced by the iteration previous to the subsequent iteration to produce a corresponding other one of the sequence of updated parameter values, wherein the value of the decoded parameter signal comprises the updated parameter value corresponding to a last one of the iterations.

5. The method of claim 1 wherein the communications system decoder comprises a speech decoder and the parameters comprise speech parameters.

6. The method of claim 5 wherein the speech parameters comprise linear prediction coefficients.

7. The method of claim 5 wherein the speech parameters comprise line spectral frequencies.

8. The method of claim 1 wherein the coded parameter signals comprise codebook indices.

9. A communications system decoder which decodes a sequence of coded parameter signals to generate a decoded parameter signal corresponding to one of the coded parameter signals, each coded parameter signal representative of a quantized value associated with a corresponding one of a sequence of parameters, the apparatus comprising means for determining an initial parameter value for the decoded parameter signal based on the quantized value represented by the coded parameter signal corresponding to the decoded parameter signal;

means for determining a parameter value to be associated with another one of the coded parameter signals based on the quantized value represented thereby;

means for generating the decoded parameter signal based on the initial parameter value and the parameter value associated with the other one of the coded parameter signals, wherein the decoded parameter signal has a value such that a distance between the value of the decoded parameter signal and the parameter value associated with the other one of the coded parameter signals is less than a distance between the initial parameter value and the parameter value associated with the other one of the coded parameter signals.

10. The apparatus of claim 9 wherein the coded parameter signal corresponding to the decoded parameter signal and the other coded parameter signal are consecutive coded parameter signals in the sequence thereof.

11. The apparatus of claim 10 wherein the means for modifying the initial parameter value is flier based on the quantized value represented by a second other one of the coded parameter signals, wherein the coded parameter signal corresponding to the decoded parameter signal and the second other coded parameter signal are also consecutive coded parameter signals in the sequence thereof.

12. The apparatus of claim 9 wherein the means for generating the decoded parameter signal comprises means for performing an iterative procedure comprising a plurality of iterations, a first one of the iterations being performed by means for modifying the initial parameter value to produce a first one of a sequence of updated parameter values, the sequence of updated parameter values corresponding to the plurality of iterations, the means for modifying which performs the first iteration based on the quantized value represented by the other one of the coded parameter signals, and each iteration subsequent to the first iteration being performed by means for modifying the updated parameter value produced by the iteration previous to the subsequent iteration to produce a corresponding other one of the sequence of updated parameter values, wherein the value of the decoded parameter signal comprises the updated parameter value corresponding to a last one of the iterations.

13. The apparatus of claim 9 wherein the communications system decoder is adapted for use as a speech decoder and wherein the parameters comprise speech parameters.

14. The apparatus of claim 13 wherein the speech parameters comprise linear prediction coefficients.

15. The apparatus of claim 13 wherein the speech parameters comprise line spectral frequencies.

16. The apparatus of claim 9 wherein the coded parameter signals comprise codebook indices.

* * * * *